US011641946B2

(12) United States Patent
Antonucci

(10) Patent No.: US 11,641,946 B2
(45) Date of Patent: May 9, 2023

(54) MULTI-DIRECTIONAL GLIDING ARM REST PAD DEVICE

(71) Applicant: Daniel Antonucci, Pittsburgh, PA (US)

(72) Inventor: Daniel Antonucci, Pittsburgh, PA (US)

( * ) Notice: Subject to any disclaimer, the term of this patent is extended or adjusted under 35 U.S.C. 154(b) by 79 days.

(21) Appl. No.: 17/391,812

(22) Filed: Aug. 2, 2021

(65) Prior Publication Data

US 2022/0031079 A1 Feb. 3, 2022

Related U.S. Application Data

(60) Provisional application No. 63/060,381, filed on Aug. 3, 2020.

(51) Int. Cl.
*A47C 16/00* (2006.01)

(52) U.S. Cl.
CPC ..... *A47C 16/00* (2013.01)

(58) Field of Classification Search
CPC ..... A47C 16/00; A47C 7/541
USPC ..... 248/118, 118.1, 118.3, 118.5
See application file for complete search history.

(56) References Cited

U.S. PATENT DOCUMENTS 6,017,091 A * 1/2000 Cao ..... A47C 1/03 297/411.37
6,467,737 B1 * 10/2002 Dorantes ..... A47B 21/0371 248/118.1
6,974,189 B2 * 12/2005 Machael ..... A47C 1/03 297/411.36
7,159,947 B1 1/2007 Lee
7,201,449 B2 * 4/2007 Tsai ..... A47C 1/0308 297/411.36
7,387,341 B1 * 6/2008 Tsai ..... A47C 1/0307 297/411.37
8,246,117 B2 * 8/2012 Melhuish ..... A47C 1/0308 297/411.37
8,496,295 B2 * 7/2013 Chen ..... A47C 1/03 297/411.31
8,840,188 B2 * 9/2014 Diffrient ..... A47C 1/0307 297/411.31
9,592,757 B2 * 3/2017 Machael ..... B60N 2/767
9,907,403 B2 * 3/2018 Lin ..... A47C 1/03
2014/0167478 A1 * 6/2014 Bauer ..... A47C 7/54 297/411.38
2015/0298587 A1 10/2015 Machael

* cited by examiner

*Primary Examiner* — Muhammad Ijaz
(74) *Attorney, Agent, or Firm* — Gwen R. Acker Wood; Acker Wood IP Law, LLC

(57) ABSTRACT

The present invention provides a unique, compact, soft-cushioned, multi-directional, 360° gliding arm rest pad device which effectively eliminates forearm-to-pad friction during movement of a user's arm in any direction when operating a device, such as a computer mouse, a joystick or any other equipment that may place stress and strain on one's hands, arms, and elbows. The multi-directional gliding arm rest pad device allows free movement of a user's forearm to glide multi-directionally with minimal tension resistance, so that shoulder strain is substantially reduced, development of bursitis, carpal tunnel syndrome, cubital tunnel syndrome, and elbow pain is greatly diminished, and a user's functional work performance duration time is extended due to reduction of hand and arm fatigue afforded by the smooth and effortless directional movement of the arm rest pad.

14 Claims, 9 Drawing Sheets

MULTI-DIRECTIONAL GLIDING ARM REST PAD DEVICE

CROSS REFERENCE TO RELATED APPLICATIONS

The present application claims priority to U.S. Provisional Application No. 63/060,381, filed Aug. 3, 2021, which is incorporated herein by reference in its entirety.

FIELD OF THE INVENTION

The present invention relates generally to a moveable arm rest pad and, more particularly, to a multi-directional, 360°, gliding arm rest pad device that eliminates forearm-to-pad friction during movement of a user's arm when operating a device, such as a joystick, a computer mouse and the like.

BACKGROUND OF THE INVENTION

Arm rest pads can be very beneficial to support one's arms in various positions while sitting in a chair at a computer, other work stations, or operating a joy stick in industrial applications. One's arms together with one's hands consist of about 10% of a person's body weight. Thus, a good arm rest pad can prevent, as well as provide good relief for, musculoskeletal disorders like bursitis, carpal tunnel syndrome, cubital tunnel syndrome, and elbow pain.

Currently, there are many different kinds of arm rest pads in the marketplace, with most of them having some type of padding. However, most arm rest pads have a limited range of motion, namely, forward or backward or side to side movement, i.e., movement limited to 180°. Some arm rests made of brackets have a wider range of motion but typically are cumbersome which limits the settings in which they can be used, and tend to become uncomfortable after a while. Thus, there exists a need for an arm rest pad that is multi-directional, i.e., has a full range of motion of 360°, that is extremely comfortable, compact, and that can be used in a wide variety of settings where one needs to sit for work or for play.

SUMMARY OF THE INVENTION

The present invention fulfills this need by proving a unique, soft-cushioned, free-moving, multi-directional, gliding arm rest pad device which eliminates forearm-to-pad friction during a user's arm movements. The multi-directional gliding arm rest pad allows free movement of a user's forearm to glide multi-directionally with minimal tension resistance, so that shoulder strain is substantially reduced, development of bursitis, carpal tunnel syndrome, cubital tunnel syndrome, and elbow pain is greatly diminished, and a user's functional work performance duration time is extended due to reduction of arm fatigue afforded by the smooth and effortless directional motion of the arm rest pad.

The multi-directional gliding arm rest pad device provides these benefits in part due to the inclusion of a plurality of ball transfer units, which have been designed to allow for multi-directional function. The present invention therefore eliminates the need for mechanical pivot, tilt, swivel or articulation of the physical arm rest pad, resulting in enhancement of control movement precision by a user when using a computer mouse or a joy stick in industrial applications, such as, without limitation, cranes, winches, marine equipment, agricultural machines, forestry machines, construction equipment, material handling vehicles, robotics, medical apparatuses, office chairs and factory production lines.

The multi-directional gliding arm rest pad device is comprised of an arm rest pad; a box lid having a first side, a second side, an upper side, a lower side, and two circular openings therein; a box base having a first side and a second side; a pad connection bracket having a raised central portion and a circular opening located on each side of the raised central portion; a plurality of sealed bearings; a glide plate having a top side and a bottom side, the top side having two circular recessed areas therein and a circular opening in the center of each recessed area; and a plurality of ball transfer units.

The multi-directional gliding arm rest pad device of the present invention is assembled by affixing two ball transfer units to one end of the bottom of the glide plate and two ball transfer units to the other end of the bottom of the glide plate. A bolt is inserted into each of the openings on the pad connection bracket, a washer is inserted over each of the bolts, one sealed bearing is inserted over each of the washers, and another washer is inserted over each of the sealed bearings to form a pad connection bracket assembly. The pad connection bracket assembly is positioned atop the upper side of the box lid so that each of the sealed bearings inserts into each of the openings in the box lid. The top of the glide plate is positioned on the underside of the box lid so that each of the two bolts insert into each of the openings in the glide plate and each of the two sealed bearings insert into each of the two circular recessed areas on the top side of the glide plate. The glide plate is affixed to the underside of the box lid with two nuts which are tightened on each of the two bolts. Optionally, a magnet is placed in the center of the bottom of the glide plate and another magnet is placed in the center of the box base. The box base is placed atop an arm of a chair and affixed thereto with screws inserted into screw holes located at the corners of the base bottom. The arm rest pad connection bracket assembly which is affixed to the upper side of the box lid with the glide plate affixed to the underside of the box lid is positioned over the box base and affixed to the box base with screws inserted into two screw holes located at the ends of the box lid and the box base. The arm rest pad then is affixed atop the arm rest pad connection bracket.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

Figure 1:
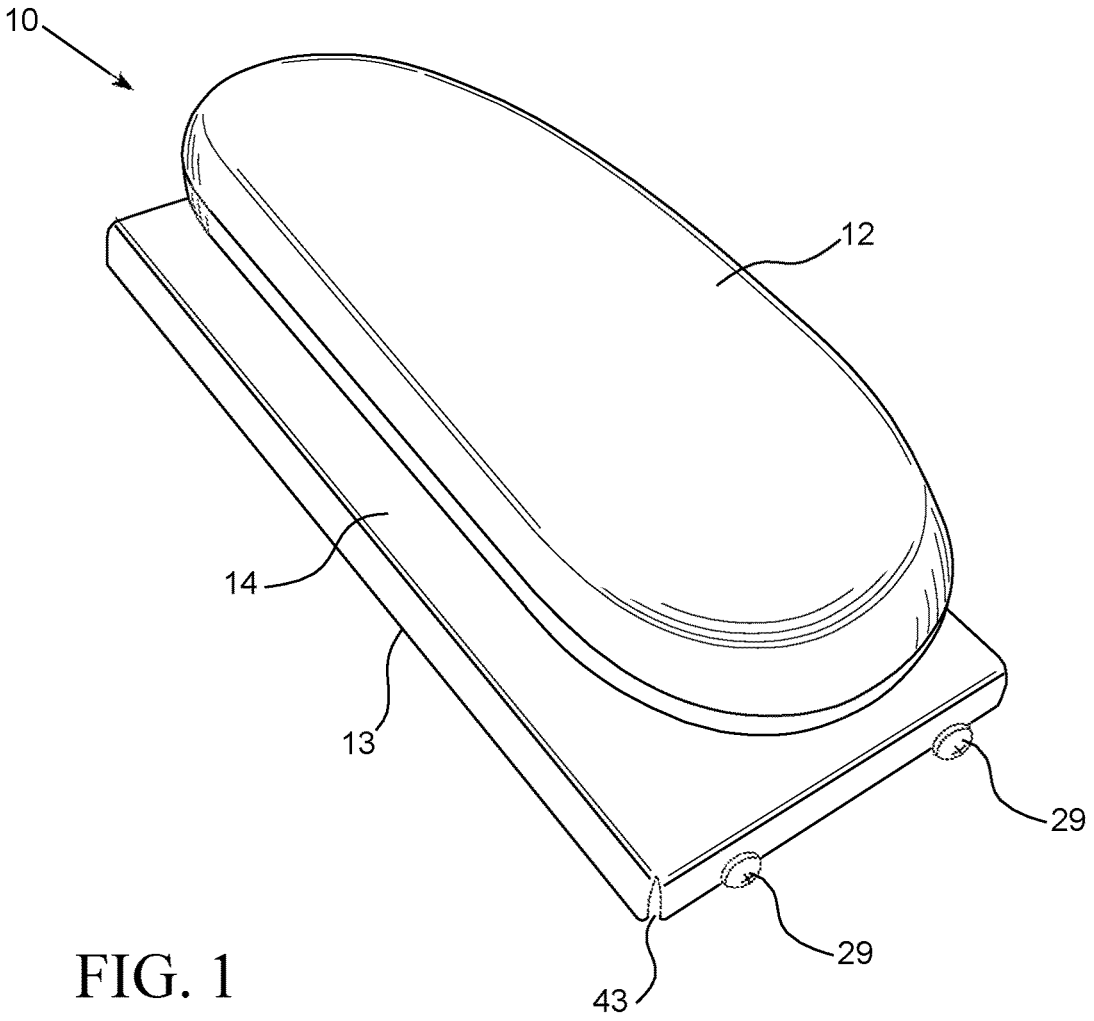
FIG. 1. is a top perspective view of the multi-directional gliding arm rest pad device, in accordance with an embodiment of the invention.
Figure 2:
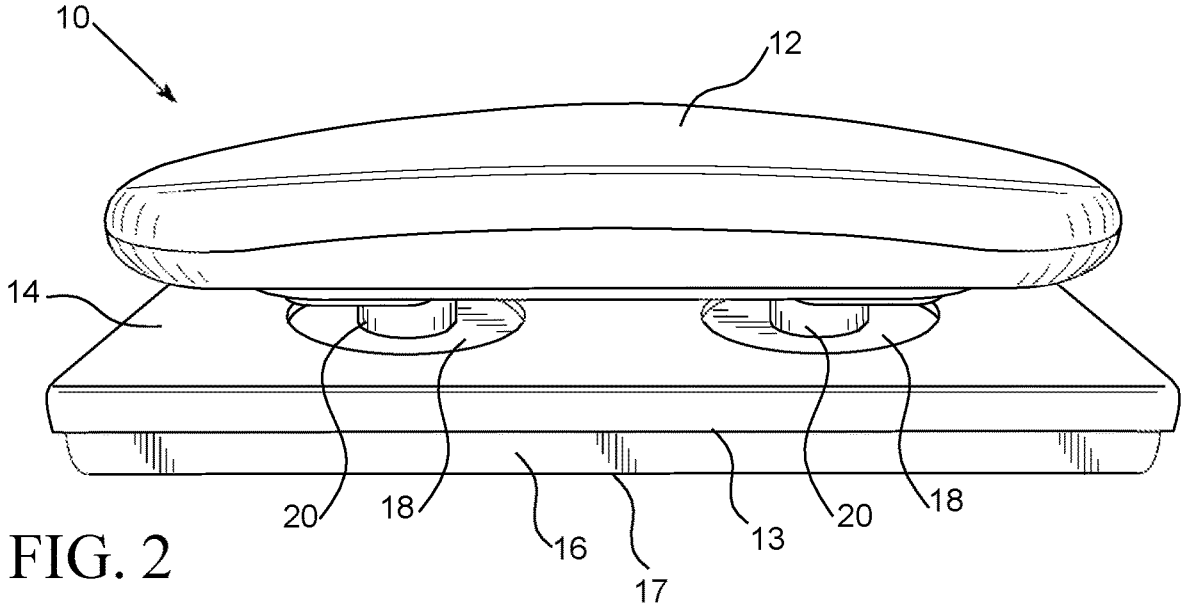
FIG. 2 is a side perspective view of the multi-directional gliding arm rest pad device, in accordance with an embodiment of the invention.
Figure 3:
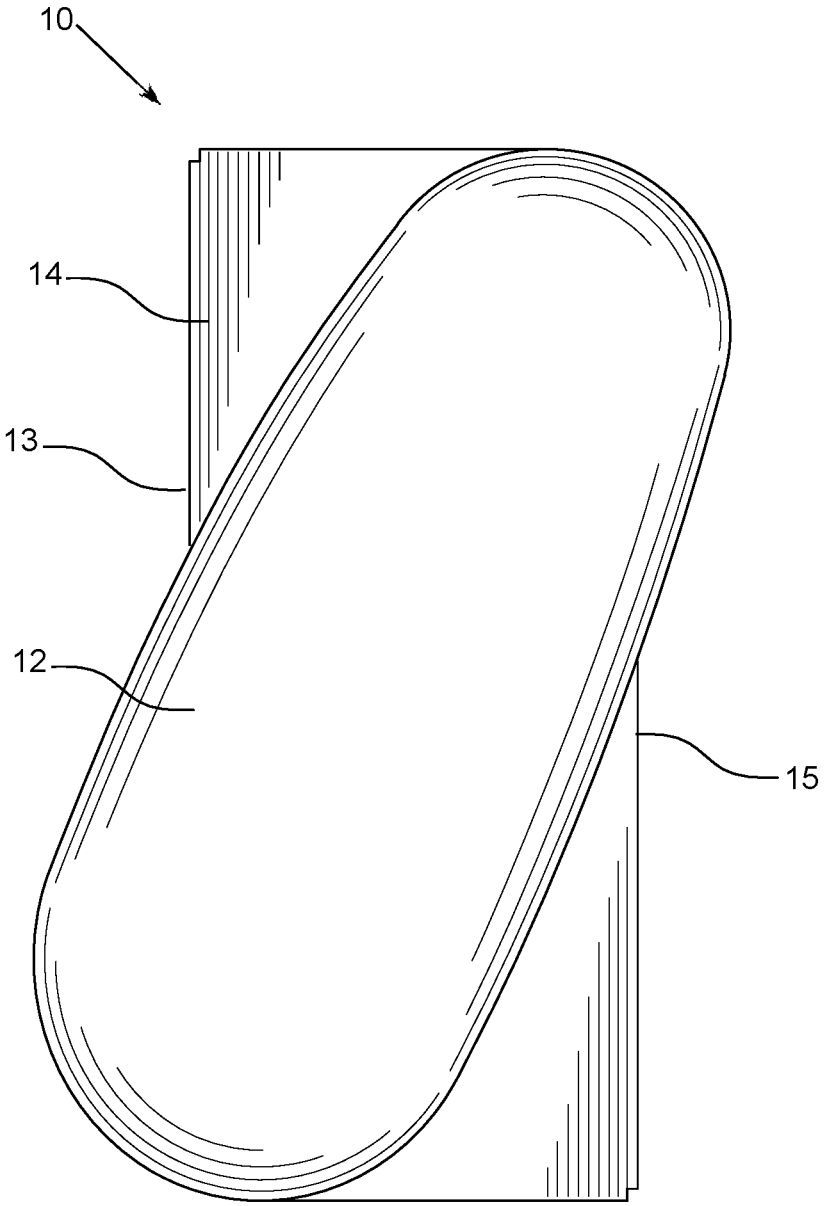
FIG. 3 is a top plan view of the multi-directional gliding arm rest pad device with the arm rest pad positioned in a rightward direction, in accordance with an embodiment of the invention.

Referring now to the figures, the multi-directional gliding arm rest pad device 10 of the invention generally is shown in FIGS. 1-3. The multi-directional gliding arm rest pad device 10 is comprised of an arm rest pad 12; a box lid 14 having a first side 13, a second side 15, an upper side 35, and an underside 21 (shown in FIGS. 4A and 7); and a box base 16 having a first side 17 and a second side 19. The box lid 14 has a length ranging from about 5.0 inches to about 20 inches, and a width ranging from about 2.0 inches to about 5.0 inches. In an embodiment, the box lid has length of about 10.2 inches and a width of about 4.2 inches. The box base 16 has a length ranging from about 5.0 inches to about 20.0 inches, and a width ranging from about 2.0 inches to about 5.0 inches. In an embodiment, the box base 16 has length of about 9.9 inches and a width of about 3.9 inches. The invention contemplates that the box lid 14 is very slightly larger than the box base 16 so that there is a snug fit when the box lid 14 fits over the box base. The invention also contemplates that the box lid 14 and box base 16 are rectangular in shape, although various other shapes, such as oblong, may be used in the invention so long as the device fits compactly and comfortably atop an arm rest.

Figure 4A:
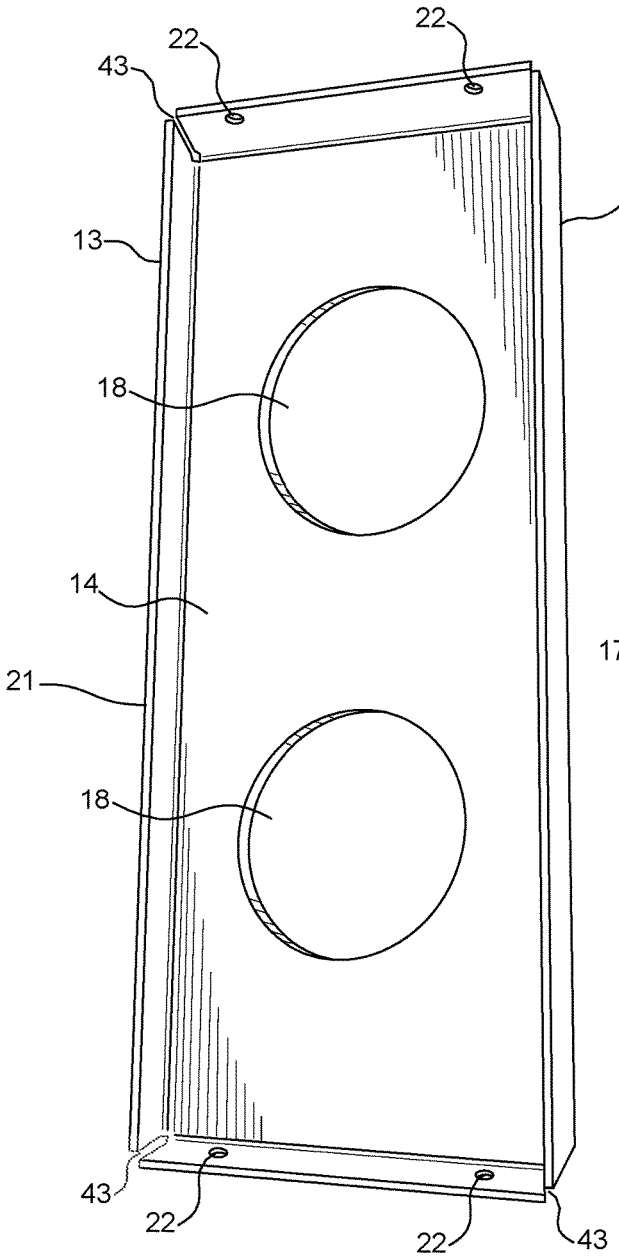
FIG. 4A is a perspective view of the under side of the box lid and FIG. 4B is a perspective view of the box base, in accordance with an embodiment of the invention.
Figure 4B:
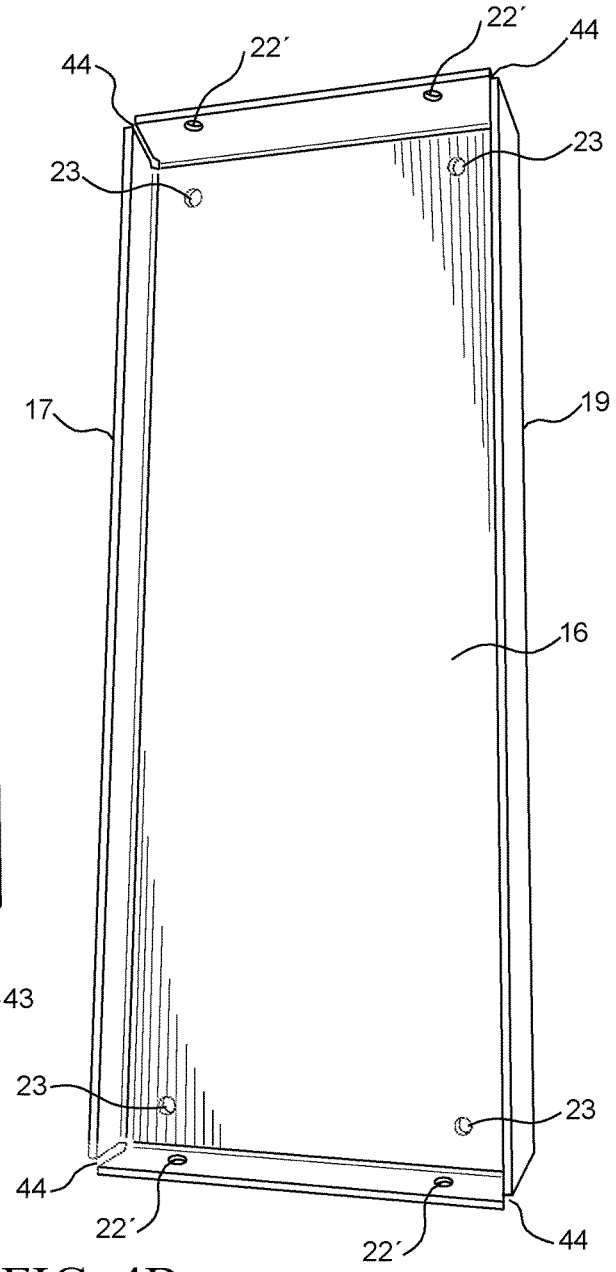

As shown in FIG. 4A, the box lid 14 has two circular openings 18 therein. Each of the circular openings has a diameter ranging from about 0.5 inches to about 5.0 inches. In an embodiment, the diameter is about 2.5 inches. Both the box lid 14 and the box base 16 have two screw holes 22, 22' on their ends and a small cleft 43, 44 on each corner of the box lid 14 and box base 16, respectively, which allows the box lid 14 to fit securely on the box base 16. In addition, the box base 16 has four small screw holes 23 near each corner of the box base 16, which are used to screw the box base 16 onto an arm rest.

Figure 5A:
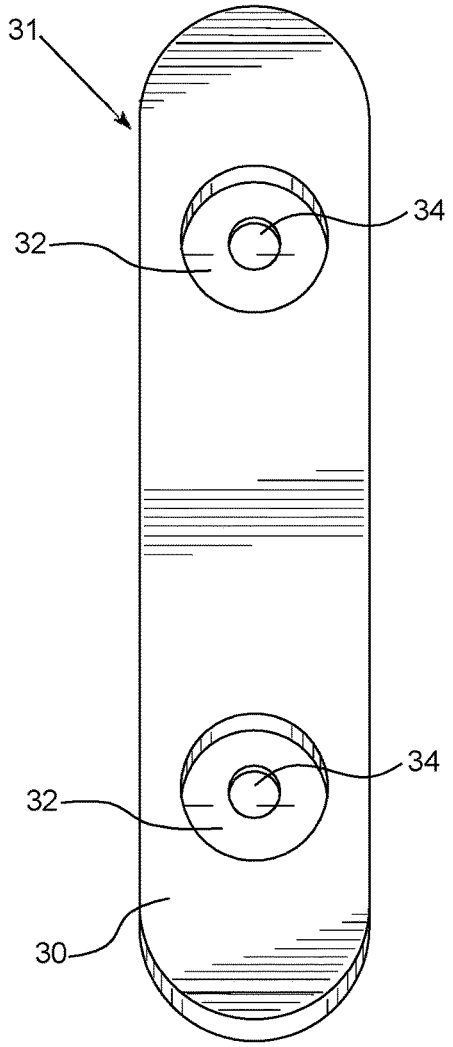
FIG. 5A is a perspective view of the top side of the glide plate and FIG. 5B is a perspective view of the bottom side of the glide plate, in accordance with an embodiment of the invention.
Figure 5B:
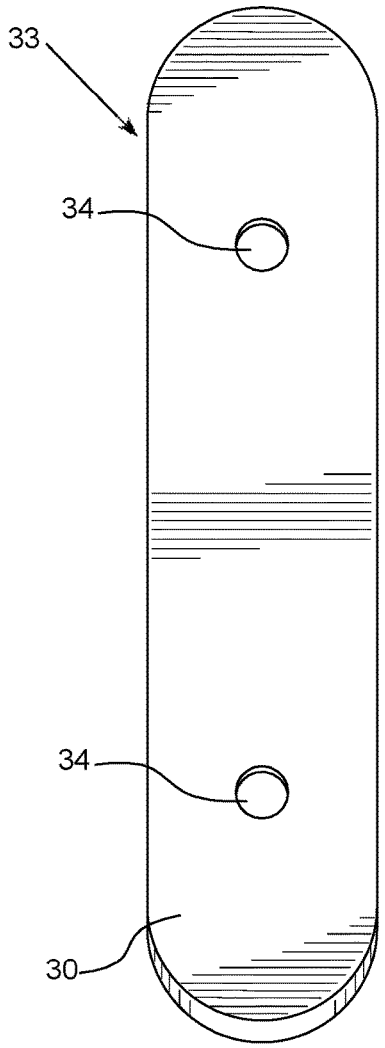

As shown in FIGS. 5A and B, the device includes a glide plate 30 having a top side 31 (FIG. 5A) and a bottom side 33 (FIG. 5B). The glide plate has a length ranging from about 2.0 inches to about 20.0 inches; and width ranging from about 0.3 inches to about 5.0 inches. In an embodiment, the glide plate 30 has a length of about 7.5 inches and a width of about 1.8 inches. The top side 31 of the glide plate 30 has two circular recessed areas therein 32 and a circular opening 34 in the center of each recessed area 32. Each of the recessed areas 32 has a diameter ranging from about 0.1 inches to about 5.0 inches. In an embodiment, the diameter of the recessed areas 32 is about 1.1 inches. The circular opening 34 in the recessed area 32 has a diameter ranging from about 0.03 inches to about 2.0 inches. In an embodiment, the circular opening 34 in the recessed area 32 has a diameter of about 0.38 inches.

Figure 6:
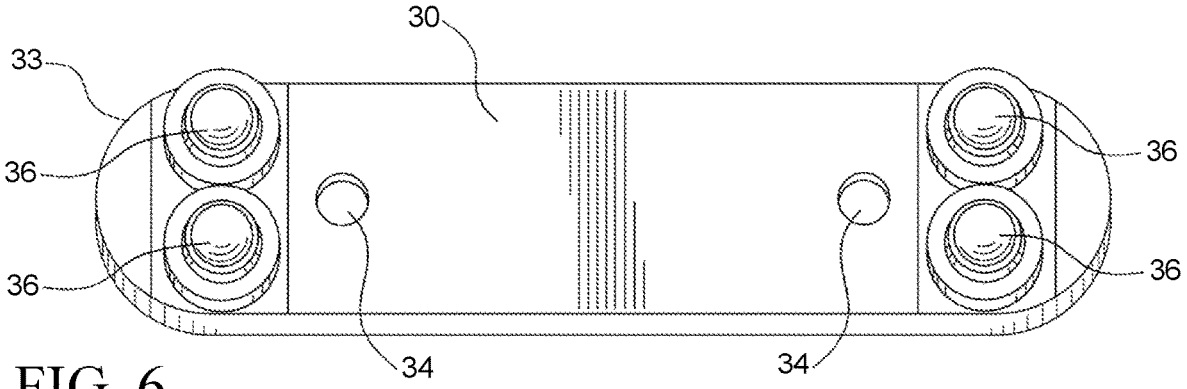
FIG. 6 is a perspective view of the bottom of the glide plate showing four ball transfer units affixed to both ends of the glide plate, in accordance with an embodiment of the invention.

As shown in FIG. 6, two ball transfer units 36 are affixed near each end of the bottom 33 of the glide plate 30. The diameter of the ball transfer units 36 ranges from about 5.0 mm to about 40.0 mm. In an embodiment, the diameter is about 22.0 mm. The height of the ball transfer units 36 ranges from about 8.0 mm to about 30.0 mm. In an embodiment, the height is 17.6 mm. The ball transfer units 36 may be manufactured from materials such as, without limitation, stainless steel, carbon steel or nylon.

Figure 7:
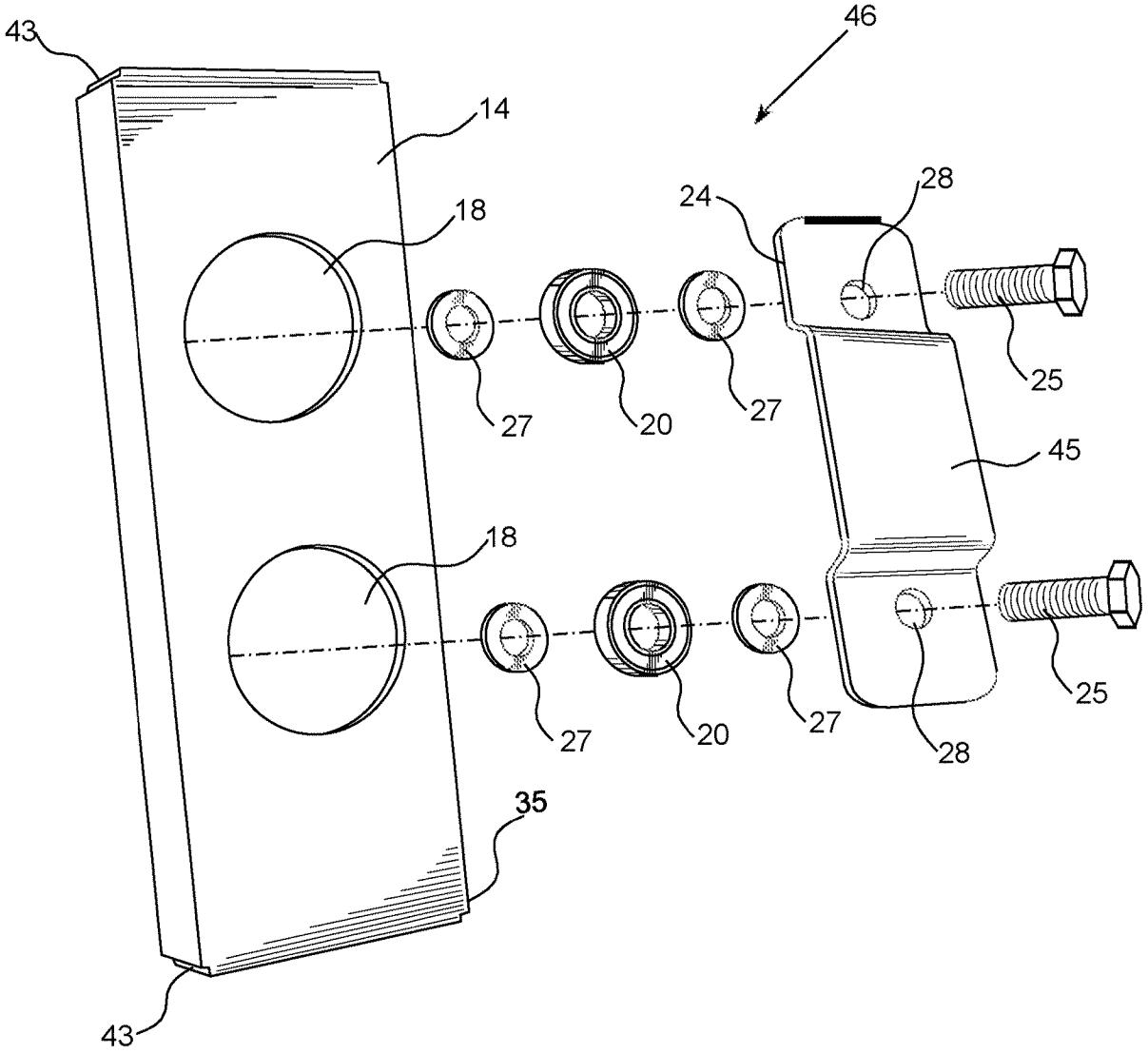
FIG. 7 is an exploded view of the arm rest pad connection bracket assembly comprised of the arm rest pad connection bracket, bolts, two sealed bearings, washers, and the box lid, in accordance with an embodiment of the invention.

As shown in FIG. 7, the device also includes an arm rest pad connection bracket 24 having a raised central portion 45, a circular opening 28 located on each side of the raised central portion 45, and two sealed bearings 20. The arm rest connection bracket 24 has a length and width ranging from about 0.25 inches to about 15.0 inches. In an embodiment, the arm rest connection bracket 24 has a length of about 6.3 inches and a width of about 2.0 inches. The diameter of the sealed bearings 20 ranges from about 0.5 inches to about 2.0 inches. In an embodiment, the diameter of the sealed bearings 20 is about 1.0 inch. In another embodiment, a small metal sleeve (not shown) less than 1.0 in diameter may replace the sealed bearings 20.

Again referring to FIG. 7, an arm rest pad connection bracket assembly 46 is assembled by inserting a bolt 25 into each of the openings 28 of the arm rest pad connection bracket 24, inserting a washer 27 over the bolt 25, inserting one sealed bearing 20 over the washer 27, and inserting another washer 27 over the sealed bearing 20. The arm rest pad connection bracket assembly 46 in positioned over the upper side 35 of the box lid 14.

Figure 8:
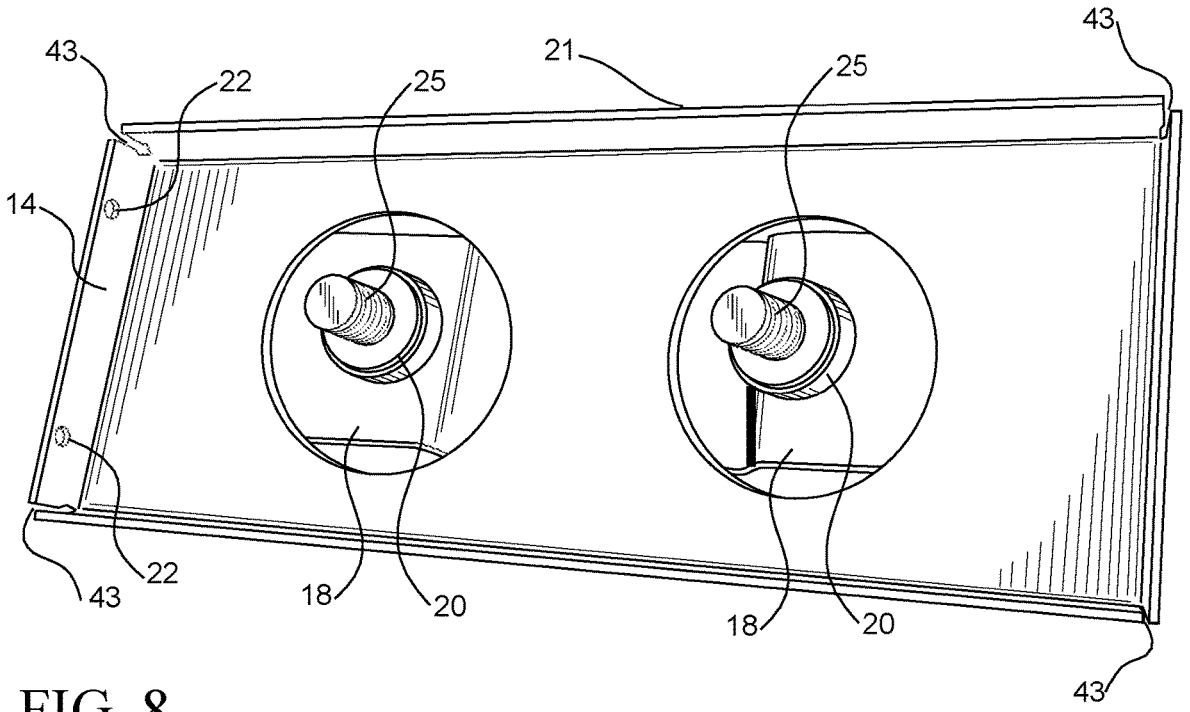
FIG. 8 is a perspective view of the arm rest pad connection bracket assembly positioned on the top side of the box lid and showing the bolts with sealed bearings thereon protruding out of the openings on the box lid, in accordance with an embodiment of the invention.

FIG. 8 shows the arm rest pad connection bracket assembly 46 positioned atop the upper side 35 of the box lid 14 so that each of the bolts 25 and the sealed bearings 20 protrude out of one of the openings 18 in the box lid 14.

Figure 9:
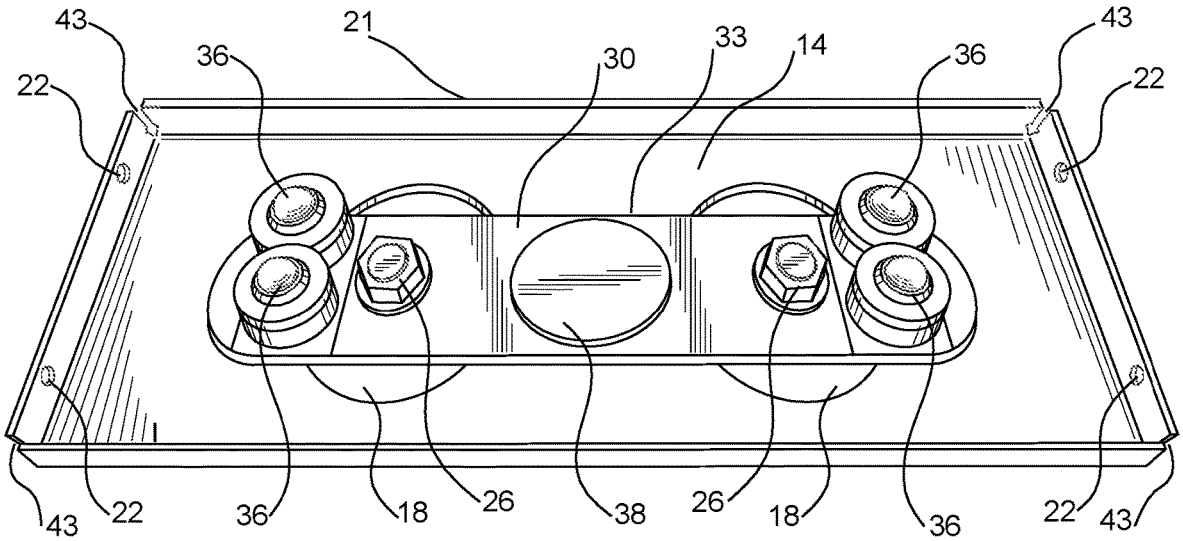
FIG. 9 is a perspective view of the glide plate affixed to the underside of the box lid with a magnet affixed in the center of the glide plate, two ball transfer units affixed on each end of the glide plate, and two nuts screwed onto the two bolts, in accordance with an embodiment of the invention.
Figure 10:
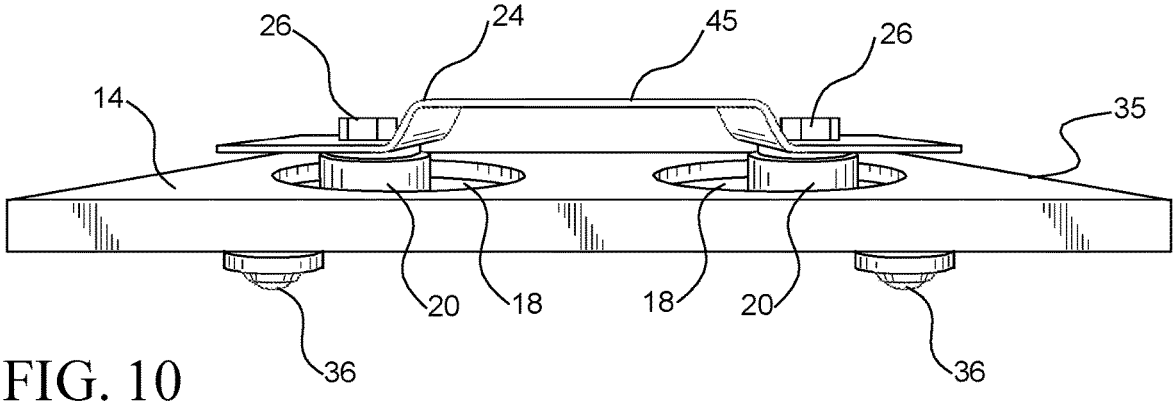
FIG. 10 is a perspective view of the arm rest pad connection bracket assembly affixed to the upper side of the box lid with the glide plate affixed to the underside of the box lid in which the sealed bearings are shown in the openings of the box lid and the ball transfer units are shown on the underside of the box lid, in accordance with an embodiment of the invention.

FIG. 9 shows the bottom 33 of the glide plate 30 positioned on the underside 21 of the box lid 14 so that each of the two bolts 25 insert into each of the openings 34 in the glide plate 30. The glide plate is affixed to the underside 21 of the box lid 14 with nuts 26 that are tightened onto each of the two bolts 25. Also shown is a circular magnet 38 centered on the bottom 33 of the glide plate 30. Shown in FIG. 10 are the two sealed bearings 20 inserted into the two circular openings 18 of the box lid 14, each of the sealed bearings 20 resting atop one of the circular recessed areas 32 (not shown) on the top side 31 of the glide plate 30.

Figure 11:
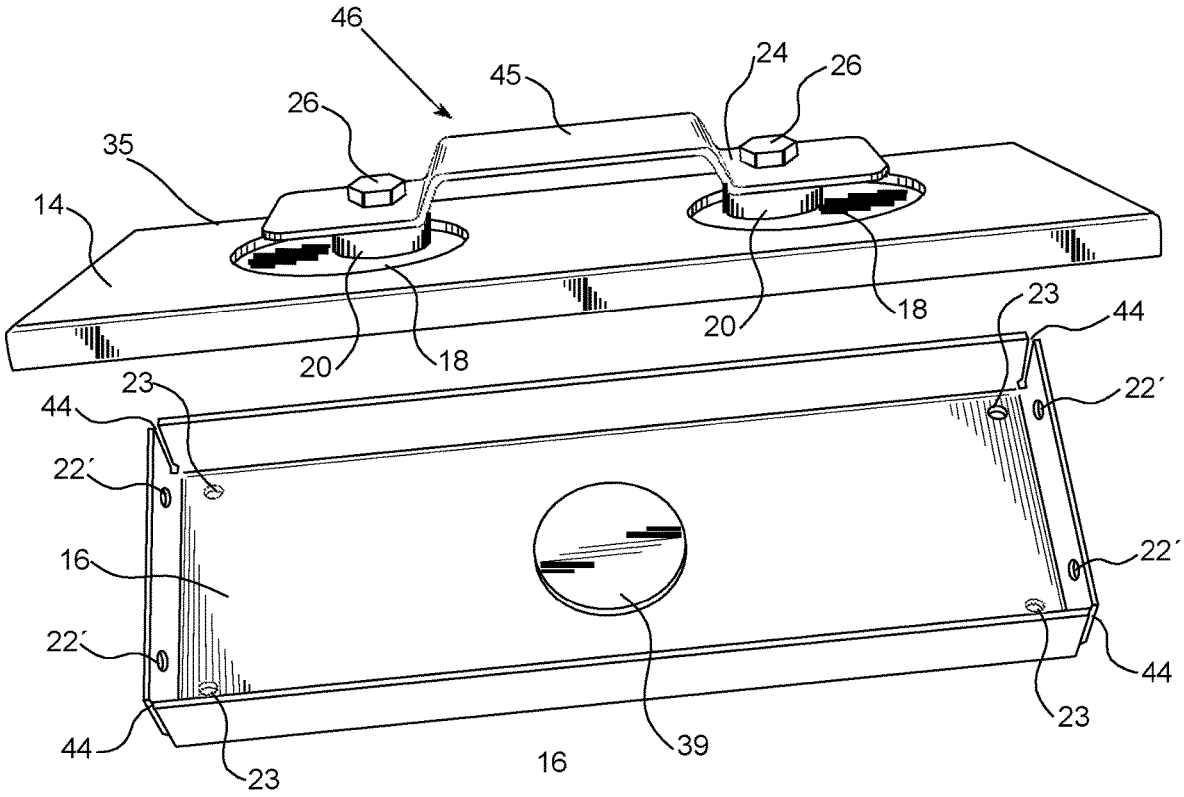
FIG. 11 is a perspective view of the arm rest pad connection bracket assembly affixed to the upper side of the box lid with the glide plate affixed to the underside of the box lid and a perspective view of the box base in which a magnet is affixed in the center of the box base, in accordance with an embodiment of the invention.

FIG. 11 shows the arm rest pad connection bracket assembly 46 affixed to the top of the box lid 14, with the sealed bearings 20 shown within the openings 18 of the box lid 14. Also shown is the box base 16 with a magnet 39 positioned and affixed in the center of box base 16 so that it directly meets and attracts the magnet 38 affixed to the glide plate 30 shown in FIG. 9. Suitable magnets include, without limitation, neodymium or ceramic magnets. The arm rest pad connection bracket assembly 46 affixed to the upper side 35 of the box lid 14 with the glide plate affixed to the underside 21 of the box lid 14 is positioned over the box base 16 and affixed thereto with screws inserted into the two screw holes 22, 22' located at the ends of the box lid 14 and the box base 16.

Figure 12A:
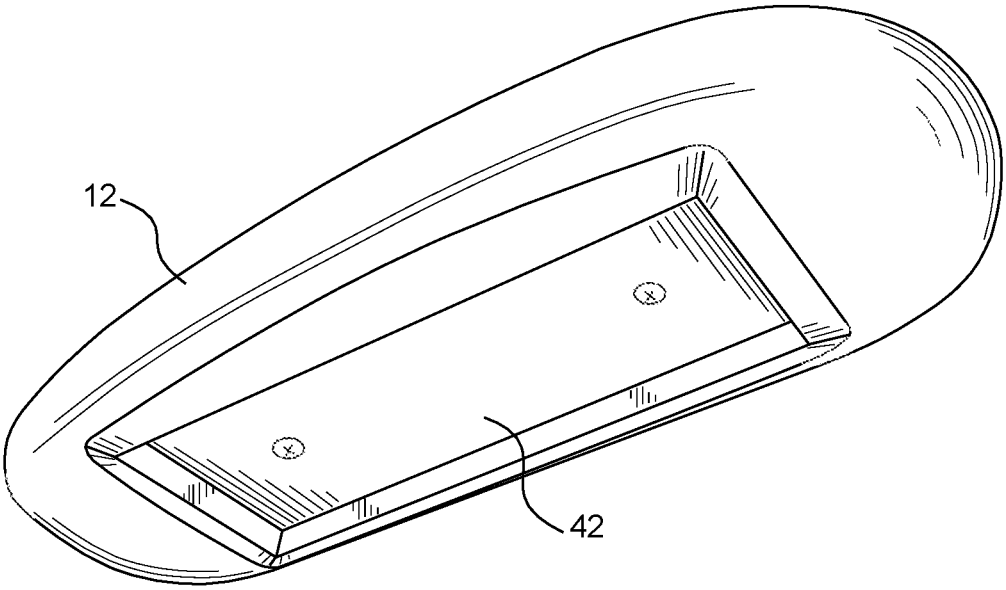
FIG. 12A is a perspective view of the bottom side of the arm rest pad showing the recessed area that affixes over the arm rest pad connection bracket of the assembled box which is shown in FIG. 12B.
Figure 12B:
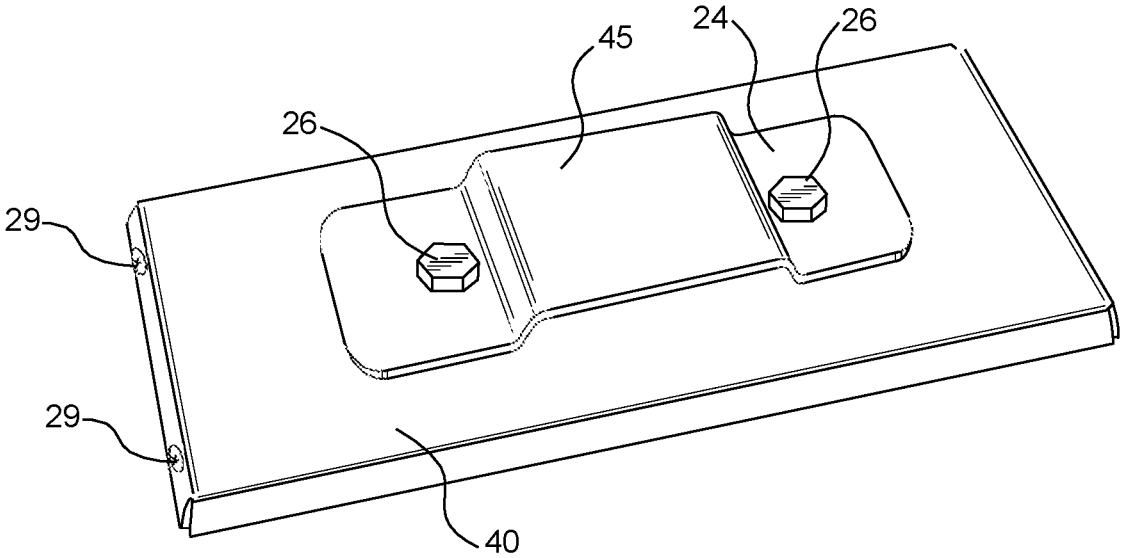

As shown in FIGS. 12A, B, the recessed area 42 of the arm rest pad 12 rest pad is configured to affix atop the raised central portion 45 of the arm rest pad connection bracket 24. In use, the box base 16 is attached to an arm rest with screws that insert into the four screw holes 23 in the box base 16 prior to affixing it to the box lid 14 with affixed previously-described elements. The completely assembled box lid affixed to the box base 40 is shown in FIG. 12B. The height of the assembled box lid and box base 40 has a height ranging from about 0.3 inches to about 3.0 inches. In an embodiment, the height of the assembled box lid and box base 40 is about 1.1 inches.

The invention contemplates that any suitable attachment means may be used to affix the ball transfer units 36 to the bottom 33 of the glide plate 30, one magnets 38 to the bottom 33 of the glide plate 30, another magnet 39 to the box base 16, and the recessed area 42 of the arm rest pad 12 to the raised central portion 45 of the arm rest pad connection bracket 24, such as, without limitation, adhesive tapes, glues, or hook and loop fasteners.

In use, the sealed bearings 20 roll freely around within the confines of the two openings 18 in the box lid 14. This rolling motion of the sealed bearings 20 in conjunction with the ball transfer units 36 provides a very smooth, gliding, 360° motion of the arm rest pad device 10. In addition, if magnets are included in the device, the magnetic attraction between the two magnets maintains itself during movement and provides a degree of resistance depending on the strength of the magnets as the arm rest connection bracket is moved via the arm rest pad in any direction. Alternatively, the multi-directional gliding arm rest pad device is configured to function with the same smooth and stable 360° degree movement without magnets if no resistance to the movement is desired by a user.

While specific embodiments have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the (device) and method described herein, which is to be given the full breadth of the appended claims and any and all equivalents thereof.

What is claimed is:

1. A multi-directional gliding arm rest pad device, comprising:

an arm rest pad;

a box lid having a first side, a second side, and two circular openings therein;

a box base having a first side and a second side;

a glide plate having a top side and a bottom side, said top side having two circular recessed areas therein and a circular opening in a center of each of said recessed area;

a plurality of ball transfer units;

an arm rest pad connection bracket having a raised central portion and a circular opening located on each side of the raised central portion; and a plurality of sealed bearings wherein a first pair of said plurality of ball transfer units are affixed to one end of a bottom of the glide plate and a second pair of said plurality of ball transfer units are affixed to another end of the bottom of the glide plate.

2. The multi-directional gliding arm rest pad device of claim 1, further comprising an arm rest pad connection bracket assembly, said arm rest pad connection bracket assembly comprised of a bolt inserted into each of the openings on the arm rest pad connection bracket, a washer inserted over each of the bolts, one sealed bearing inserted over each of the washers, and another washer inserted over each of the sealed bearings.

3. The multi-directional gliding arm rest pad device of claim 2, wherein the arm rest pad connection bracket assembly is positioned atop an upper side of the box lid so that each of the sealed bearings inserts into each of the openings in the box lid.

4. The multi-directional gliding arm rest pad device of claim 3, wherein the top side of the glide plate is positioned on an underside of the box lid so that each of said each bolt inserts into each of the openings in the glide plate and each of two of the plurality of sealed bearings insert into each of the two circular recessed areas on the top side of the glide plate, wherein the glide plate is affixed to the underside of the box lid with two nuts, each of the two nuts tightened on each of each said bolt.

5. The multi-directional gliding arm rest pad device of claim 1, wherein a magnet is placed in the center of the bottom side of the glide plate.

6. The multi-directional gliding arm rest pad device of claim 5, wherein a magnet is placed in the center of the box base.

7. The multi-directional gliding arm rest pad device of claim 5, wherein the placement of the magnet on the glide plate matches the placement of the magnet in the box base so that the magnet on the glide plate attracts the magnet in the box base.

8. The multi-directional gliding arm rest pad device of claim 7, wherein the magnets are neodymium or ceramic magnets.

9. The multi-directional gliding arm rest pad device of claim 8, wherein the box base is placed atop an arm of a chair and affixed thereto with screws inserted into screw holes located at the corners of the bottom side of the base.

10. The multi-directional gliding arm rest pad device of claim 9, wherein the arm rest pad connection bracket assembly affixed to the box lid having the glide plate affixed thereto is positioned over the box base and affixed to the box base with the screws inserted into two screw holes located at the respective ends of the box lid and the box base.

11. The multi-directional gliding arm rest pad device of claim 10, wherein a recessed area of the arm rest pad is affixed atop the arm rest pad connection bracket.

12. The multi-directional gliding arm rest pad device of claim 11, wherein the magnet on the glide plate and the magnet in the box base exert a resistance to a gliding movement of the arm rest pad, said resistance having a magnitude dependent on the strength of the magnetic attraction between the magnet on the glide plate and the magnet in the box base.

13. The multi-directional gliding arm rest pad device of claim 12, wherein the arm rest pad exhibits a smooth, multi-directional, 360° gliding movement throughout the entire area within the openings in the box lid.

14. The multi-directional gliding arm rest pad device of claim 1, wherein the shape of the box lid and the box base is rectangular or oblong.

* * * * *